United States Patent [19]

Nowacki et al.

[11] Patent Number: 5,047,685

[45] Date of Patent: Sep. 10, 1991

[54] ELECTRODE STRUCTURE FOR LITHOTRIPTER

[76] Inventors: Christopher Nowacki, 1552 Chickamauga, Long Grove, Ill. 60047; Mark T. Horbal, 2 South 530 Iroquois Courts West, Warrenville, Ill. 60555

[21] Appl. No.: 405,425

[22] Filed: Sep. 11, 1989

[51] Int. Cl.[5] ..... H01T 13/02; A61H 1/00

[52] U.S. Cl. ..... 313/141; 128/24.1

[58] Field of Search ..... 313/128, 137, 141; 128/24 A

[56] References Cited

U.S. PATENT DOCUMENTS 1,322,687 11/1919 Gallop ..... 313/128 X 1,560,510 11/1925 Hirsch ..... 313/128

1,669,992 5/1928 Mosler ..... 313/141

*Primary Examiner*—Sandra L. O'Shea

[57] ABSTRACT

Electrode structure is provided in the reflector of a lithotripter lying on the axis of the reflector. The electrode structure has a pair of electrodes extending longitudinally along a cylinder fitting through a bore in the reflector at the apex thereof. The electrodes have inwardly turned tips with spaced confronting faces lying on opposite sides of the axis of the reflector. The electrodes exteriorly of the reflector also have terminals extending radially and rotatable into electrically engaging and electrode supporting position with a pair of fixed terminals. The fixed terminals support the electrode structure and are electrically connected to spark generating apparatus.

12 Claims, 2 Drawing Sheets

ELECTRODE STRUCTURE FOR LITHOTRIPTER

BACKGROUND OF THE INVENTION

Reduction of kidney stones and other concretions in the human body by a lithotripter is well known. A truncated ellipsoidal reflector is provided with a spark gap at the first focus point of the ellipsoid. The second focus point of the ellipsoid is beyond the truncated end of the reflector, and the reflector is positioned so that the second focus point lies on the kidney stone or other concretion to be disintegrated. The reflector is filled with water, and the water in the reflector either directly engages the human body, or engages it through a flexible diaphram of rubber or the like. An electrical spark across the gap at the first focus point causes flashing of a certain amount of water into steam, and in general generates a shockwave which is focused by the walls of the reflector and which passes through the water and through the tissues of the human body to the concretion which is to be disintegrated.

The spark gap is defined by a pair of electrodes which are disposed in spaced, aligned relation to one another. The voltage that causes the spark across the gap is on the order of 12K volts to 30K volts. This high voltage, coupled with frequent formation of sparks across the gap between the electrodes leads to erosion and deterioration of the electrodes. As a result, electrodes typically have to be replaced at least once during a treatment session for a patient, which treatment session may last on the order of one hour. Since the electrodes are under water, it has in the past been necessary to drain the reflector before the electrodes could be removed, and then to refill the reflector. This has caused various problems, the most obvious of which is the time delay during the patient must lie on treatment table, or in the case of certain lithotripters, must be left submerged in a water bath.

OBJECTS AND SUMMARY OF THE PRESENT INVENTION

In accordance with the present invention it is an object thereof to provide an electrode construction which is electrically and mechanically superior, and which can readily be changed during a treatment procedure without the necessity of draining the reflector.

It is further an object of the present invention to provide a lithotripter electrode construction including an insulating base portion made of plastic material having superior electrical and mechanical characteristics, in combination with a potting resin which completes the structure and secures the parts together.

Another object of the present invention is to provide an electrode structure for a lithotripter wherein the electrodes themselves are made of bars or wires of square cross section, and in which the spark gap lies across the rotational axis of the reflector, with the confronting ends of the two electrodes lying on opposite sides of such axis.

In carrying out the foregoing and other objects and advantages of the present invention, an upwardly opening reflector is provided. The top end of the reflector, which is ellipsoidal, is truncated, and is provided with an overlying rubber or the like diaphragm. The reflector and the space beneath the diaphragm are filled with water. The reflector is upwardly opening, and is disposed about a substantially vertical axis. Electrode structure of the present invention extends into the bottom of the reflector along the axis of rotation. Electrode structure includes a cylindrical body of non-conducting materials extending into the bottom of the reflector along the rotational axis thereof. The cylindrical body is sealed to a complimentary bore in a base secured to the bottom of the reflector and having an upper surface forming a portion of the reflector. The electrodes are disposed entirely within the cylindrical body, except at the upper end thereof where they extend axially above the body and into confrontation with one another athwart the axis of rotation of the reflector. Adjacent to bottom end of the body the electrodes project radially outwardly therefrom and externally of the reflector. These radially outwardly projecting electrode ends are readily brought into engagement with fixed contacts upon rotation of the electrode structure.

THE DRAWINGS

The present invention will best be understood when the following specification is read in connection with the accompanying drawings wherein.

DETAILED DESCRIPTION OF THE ILLUSTRATED EMBODIMENTS

Figures 1, 2, 3:
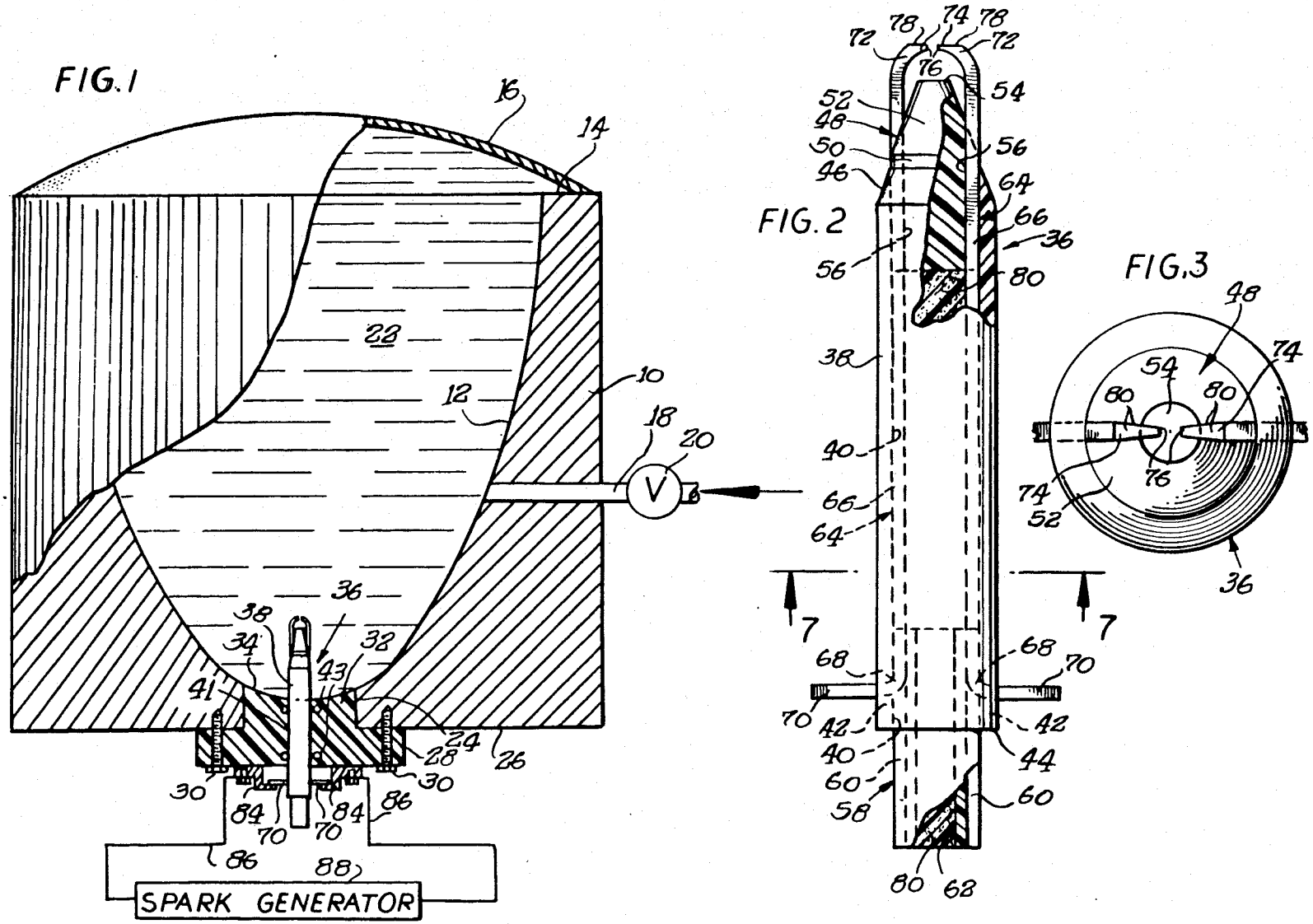
FIG. 1 is an axial section, partly in front view, of the reflector and electrode structure of a lithotripter constructed in accordance with the present invention.
FIG. 2 is a side view of the electrode structure, partly in section, and on an enlarged scale relative to FIG. 1.
FIG. 3 is a top view of the electrode structure on a further enlarged scale.

Turning now in greater particularity to the drawings, and first to FIG. 1, there will be seen a lithotripter reflector member 10 having an internal reflective surface 12 forming a portion of an ellipsoid. The structure 10 and the reflector are truncated at 14, and a rubber or the like diaphram 16 overlies the open upper end of the ellipsoidal reflector. A water supply pipe 18 extends radially into the cavity within the reflector 12 and is provided with a valve 20 for supplying water to and removing water from the reflector cavity. The reflector during use is filled with water 22 which extends above the truncated top of the reflector and causes the diaphram 16 to billow upwards in convex external shape as shown. The periphery of the diaphram is secured to the upper end of the structure 10 by any suitable or known means.

At the lower portion of the reflector structure, and specifically at the apex of the reflector surface there is provided a bore 24 extending from the reflector surface down to the outer, lower surface 26 of the structure 10. An electrode mounting body of suitable plastic material, such as nylon, is provided with a lower disc-like portion 28 secured by means of suitable bolts 30 to the underside of the structure 10. The body 24 further includes an upwardly projecting cylindrical portion 32 extending into the bore 24, and having an upper surface 34 configured to form a portion of the reflective surface of the reflector.

The electrode structure 36 is shown in small scale and in proper operating position in FIG. 1 and is shown in larger scale and in greater detail FIGS. 2–7. The electrode structure comprises an elongated cylindrical insulating member 38 which extends through a central bore 41 in the mounting member. O-rings 43 are provided about the bore 41 generally adjacent to top and bottom thereof for sealing engagement with the outer cylinder 38.

Figure 4:
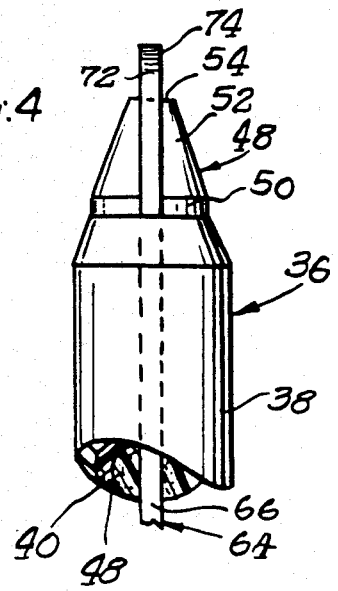
FIG. 4 is a view of the top portion of electrode structure taken at right angles to FIG. 2.
Figure 5:
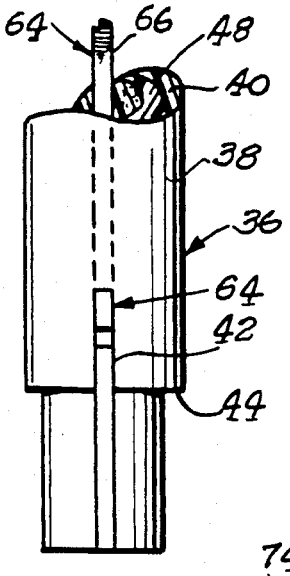
FIG. 5 is a view of the bottom portion of the electrode structure, also taken at right angles to FIG. 2.
Figure 6:
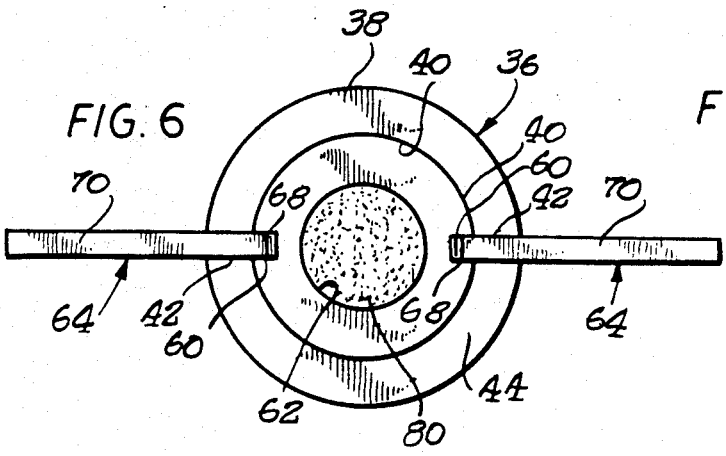
FIG. 6 is a bottom view of the electrode structure on an enlarged scale relative to FIG. 2.
Figure 7:
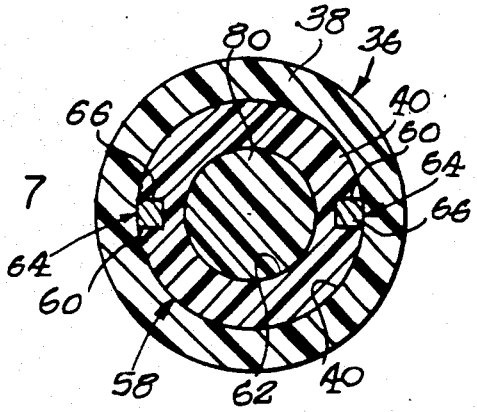
FIG. 7 is an axial sectional view through the electrode structure taken substantially along the line 7—7 in FIG. 2, on an enlarged scale.

As seen in better detail in FIGS. 2–4, the outer cylinder 38 is hollow, and is made of a synthetic resin material, preferably nylon, which has excellent electrical insulating characteristics, substantial strength, and dimensional stability. The cylinder 38 initially has a central bore 40. By way of one specific example, the outside diameter of the cylinder 38 is approximately one inch. The side wall of the cylinder is approximately one-eighth inch thick, leaving the bore 41 at three-quarters of an inch.

The cylinder 38 is open at both ends, and at the bottom end diagonally opposite notches 42 extend through the side wall and upwardly from the bottom edge 44 of the cylinder. The upper end of the cylinder tapers frustoconically at 46.

The cylinder 38 is approximately four and three-quarter inches long, and and an upper plug 48 extends upwardly nearly three-quarters of an inch beyond the upper edge of the cylinder. The plug 48 includes a cylindrical portion 50 approximately one inch long and extending down into the cylinder 38 and approximately one-eighth of an inch above the cylinder. Above the cylindrical portion the plug 48 tapers frustoconically inwardly at 52 to a flat, circular upper end approximately five-sixteenths inch in diameter. A plug 48 is provided with a pair of diametrically opposed edge-opening square channels 56 extending the length of the cylindrical portion 50 and opening at the bottom thereof, and also extending on up into the frustoconical portion 52. The channels are each approximately an one-eighth inch square.

Electrode structure 36 is also provided with a lower cylindrical plug 58 approximately one and three-quarter inches in length and extending approximately three-quarters of an inch up into the cylinder 38. The lower plug 58 is provided with a pair of channels 60 running from end to end thereof. The channels 60 are aligned with the channels 56 and are also approximately one-eighth inch square. The plug 58 is provided with a longitudinal bore 62 running from end to the end thereof and approximately three-eighths inch in diameter.

The electrode structure 38 includes a pair of electrodes 64 each including a longitudinally extending runner 66 received in the aligned channels 56 and 60. The runners are bent outwardly at 68 to form oppositely extending terminals 70 which are aligned with one another but extending in opposite directions. The terminals 70 extend radially outwardly through the notches 42 in the cylinder 38.

The electrode members 64 are made of square brass rod, approximately one-eighth inch square and fitting snugly within the channels 56 and 60. The runners extend upwardly to just beyond the flat tip 54 or the upper plug 48, and are turned inwardly at 72 to form confronting electrode tips 74. The electrode tips have confronting flat faces 76, are flattened off at the tops at 78, and are tapered inwardly along the sides at 80, whereby the tips are of substantially less transverse dimension than the runner 66, being approximately three thirty-secondth inch square. This tapering of the tips concentrates the spark. The gap is approximately 0.020 inch to 0.030 inch, and the voltage causing a spark to jump the gap runs on the order of 12 KV to 30 KV. It will be noted that the spark jumps across the center line of the electrode structure and hence across the axis of rotation of the reflector 12, greatly enhancing the probability of formation of a plasma bubble precisely in the focal zone of the reflector.

The electrode structure is completed by a molding or casting resin 80 poured or injected through the bore 62 of the lower cylindrical plug 58 to fill the interior of the body of the cylinder 38 between the plugs 48 and 58. The plugs do not form a tight fit within the cylinder 38, an consequently some of the resin finds its way between the outer surfaces of the plugs and the inner surface of the cylinder 38, thereby to solidfy and permanently join the parts of the electrode structure 36. Epoxy is a preferred resin for this purpose.

Figure 8:
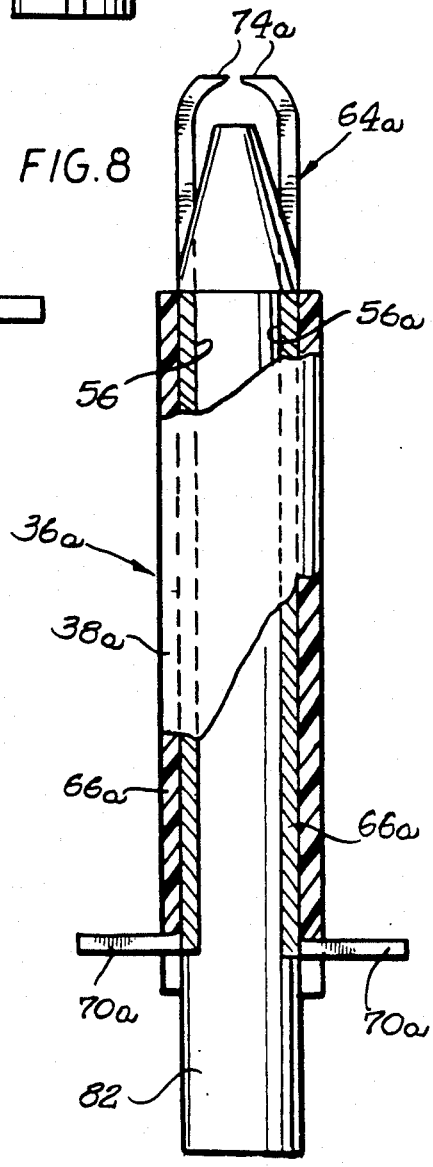
FIG. 8 is a side view, partially in axial section of a modification of the invention, this view being generally similar to that in FIG. 2.

A modification of the electrode structure is shown in FIG. 8. Most of the parts are the same as in the previous embodiment, and similar numerals are utilized with the addition of the suffix a, thereby avoiding repetition of disclosure. The significant difference is that there is single central cylinder 82 extending completely through the body or outer cylinder 38*a*, taking the place of the upper plug 48 and the lower plug 58 and also interconnecting the portions corresponding to the plugs. The entire length of the cylinder internally of the outer cylinder 38*a* if provided with channels 56*a* accommodating the longitudinal runners 66*a* of the electrodes 64*a*. In this modification an adhesive-type epoxy is utilized to secure the inner cylinder 82 within the outer cylinder 36*a*.

Attention should be returned to FIG. 1 to understand better the position and operation of the electrode unit or assembly 36. As noted heretofore, it extends through the bore 41 in the mounting body and is sealed by the O-rings 43. The electrode assembly is axially inserted in an upward direction, and then is rotated to bring the electrode connectors 70 into engagement with the upper surfaces fixed terminals 84. The fixed terminals support the electrode assembly and provide electrical contact to the electrodes. The fixed terminals 84 are connected by wires 86 to a spark generator 88, such spark generators being well known in the field of lithotripsy.

The molding or potting epoxy used in the first embodiment of the electrode structure is easy to work with, and does not require special tools. It sets completely in about three hours when heated by infrared lamps. The square bars or wires 64 used in forming the electrodes are advantageous relative to commonly used round electrode wires. The square cross section prevents rotation and provides perfect registration of the tips of the electrodes. Furthermore, while occupying a one-eighth inch square area, they provide a maximum surface area, and this is advantageous due to skin effect electrical conduction at the high voltages used. To the extent that some of the conduction is in the interior of the wire, it also provides a maximum cross sectional area of wire.

The specific embodiments of the invention as herein shown and described are for illustrative purposes only. Various changes in structure will no doubt occur to those skilled in the art, and will be understood as forming a part of the present invention insofar as they fall within the spirit and scope of the appended claims.

The invention is claimed as follows:

1. Electrode structure as for a lithotripter comprising first and second cylinders of insulating material, the first cylinder fitting inside the second cylinder, said first and second cylinders having confronting cylindrical surfaces, means securing said first cylinder in said second cylinder and said first cylinder having a pair of elongated straight channel means opening laterally to said confronting surfaces, and a pair of electrodes each having an elongated runner received in a respective channel means, each having an integral terminal portion extending from said second cylinder adjacent on end thereof for engagement with electrical connections, and each electrode having an extending tip integral with a respective electrode runner and extending beyond the other end of said second cylinder and turned toward the longitudinal axis of said second cylinder, the electrode tips being in spaced, confronting disposition to one another.

2. Electrode structure as set forth in claim 1 wherein each electrode has a square cross section.

3. Electrode structure as set forth in claim 1 wherein said terminals are insulated from one another and each electrode terminal extends at substantially right angles from the respective electrode runner and extends beyond said second cylinder laterally thereof for engagement with fixed terminal means.

4. Electrode structure as set forth in claim 1 wherein both electrode tips taper to flat confronting faces.

5. Electrode structure as set forth in claim 4 wherein each electrode has a square cross section.

6. Electrode structure as set forth in claim 4 wherein each terminal portion extends at right angles from a respective electrode runner in opposite directions radially of said second cylinder and extending radially beyond said second cylinder.

7. Electrode structure as set forth in claim 1 wherein said second cylinder is secured in said first cylinder by a plastic resin material set up in place.

8. Electrode structure as set forth in claim 1 wherein said channel means are in said first cylinder and open radially outwardly thereof.

9. Electrode structure as set forth in claim 1 wherein said first cylinder comprises a single integral cylinder extending substantially from end to end of said second cylinder and beyond at least one end thereof, said first cylinder being cemented in said second cylinder.

10. Electrode structure as for a lithotripter comprising first and second cylinders of insulating material, the first cylinder fitting inside the second cylinder, said first and second cylinders having confronting cylindrical surfaces, means securing said first cylinder in said second cylinder and said first cylinder having a pair of elongated channel means opening to said confronting surfaces, and a pair of electrodes each having an elongated runner received in a respective channel means, each having an integral terminal portion extending from said second cylinder adjacent one end thereof for engagement with electrical connections, and each electrode having an extending tip integral with a respective electrode runner and extending beyond the other end of said second cylinder and turned toward the longitudinal axis of said second cylinder, the electrode tips being in spaced, confronting disposition to one another, wherein said first cylinder comprises two axially spaced cylindrical plugs respectively disposed at opposite ends of said second cylinder, and a cast plastic resin material disposed between said plugs.

11. Electrode structure as set forth in claim 10 wherein said cylindrical plug at said one end of said first cylinder has an axial bore through which said plastic resin material extends.

12. Electrode structure as for a lithotripter comprising first and second cylinders of insulating material, the first cylinder fitting inside the second cylinder, said first and second cylinders having confronting cylindrical surfaces, means securing said first cylinder in said second cylinder and said first cylinder having a pair of elongated channel means opening to said confronting surfaces, and a pair of electrodes each having an elongated runner received in a respective channel means, each having an integral terminal portion extending from said second cylinder adjacent one end thereof for engagement with electrical connections, and each electrode having an extending tip integral with a respective electrode runner and extending beyond the other end of said second cylinder and turned toward the axis of said cylinder, the electrode tips being in spaced confronting disposition to one another, said first cylinder extending in both directions axially beyond said second cylinder, the end of said first cylinder adjacent to said electrode tips being frusto-conically tapered and having a flat tip adjacent said electrode tips.

* * * * *